United States Patent [19]

Ericsson et al.

[11] 4,089,123

[45] May 16, 1978

[54] APPARATUS FOR DRYING INK ON FRESHLY PRINTED MATERIAL

[75] Inventors: Sylve Jack Donald Ericsson, Tumba; Karl Georg Larsson, Norsborg, both of Sweden

[73] Assignee: Svecia Silkscreen Maskiner AB, Sweden

[21] Appl. No.: 682,637

[22] Filed: May 3, 1976

[30] Foreign Application Priority Data

May 13, 1975 Sweden ..... 7505456

[51] Int. Cl.[2] ..... F26B 13/00

[52] U.S. Cl. ..... 34/155; 34/217; 198/586; 198/863

[58] Field of Search ..... 34/155, 160, 216, 217; 198/586, 863

[56] References Cited

U.S. PATENT DOCUMENTS

| | | | |
|---|---|---|---|
| 2,022,593 | 11/1935 | Fuykers | 34/160 |
| 3,008,243 | 11/1961 | Kawaguchi | 34/155 |
| 3,199,224 | 8/1965 | Brown | 34/160 |
| 3,946,501 | 3/1976 | Cotterell | 34/155 |

FOREIGN PATENT DOCUMENTS

| | | | |
|---|---|---|---|
| 2,245,960 | 3/1973 | Germany | 34/155 |

*Primary Examiner*—John J. Camby
*Assistant Examiner*—Larry I. Schwartz
*Attorney, Agent, or Firm*—Burns, Doane, Swecker & Mathis

[57] ABSTRACT

An apparatus for drying the ink on freshly printed material comprises a convey path arranged for movement in a horizontal plane. Spaced vertically above the horizontal plane of movement of said conveyor path is a plurality of hot-air nozzles, the exit orifices of which lie on a common plane and are directed onto said conveyor path. The conveyor path is supported for rectilinear movement on rollers carried by a frame structure and means are provided with which this frame structure can be raised and lowered so as to increase or decrease the distance between the said two planes. This affords the advantage whereby the apparatus is able to dry sheets of printed material of varying thickness with maximum efficiency.

6 Claims, 3 Drawing Figures

APPARATUS FOR DRYING INK ON FRESHLY PRINTED MATERIAL

FIELD OF THE PRESENT INVENTION

The present invention relates to apparatus for drying the ink on printed material, especially material printed on a silk-screen printing machine, said drying apparatus comprising a frame which supports a conveyor path for horizontal movement. Drying of the print is effected by heating air in said apparatus and passing said air through a plurality of nozzles, the exit orifices of which lie on a common plane above the horizontal plane of the upper conveying surface of said path.

BRIEF DESCRIPTION OF THE PRIOR ART

It is known with such drying apparatus that the maximum efficiency of said apparatus is reached when the common plane of the nozzles exit orifices is spaced at a certain distance from the printed surface of the material,. Although this distance at which maximum efficiency is obtained largely depends upon the design of the nozzles and the speed at which the air exits therefrom, a distance of 15 mm has been found to constitute a practical value.

Since it should be possible to use a drying apparatus for printed material of different shapes and sizes, certain problems are encountered when the thickness of the printed material is excessive. It has previously been proposed that the common plane of the nozzles exit orifices shall be at such a distance from the horizontal plane of the conveyor path that material of considerable thickness is able to pass beneath the nozzles without hinder, although this affords the disadvantage when the ink on a printed sheet of normal thickness is to be dried in the apparatus, the common plane of said orifices is excessively spaced from the horizontal plane of the upper conveying surface of the conveyor path, with an impaired efficiency of the drying apparatus as a result.

To overcome these disadvantages, drying apparatus have been proposed in which the nozzles can be raised and lowered. thereby enabling the distance between the exit orifices of the nozzles and the printed material to be regulated to a pre-determined magnitude. Such a drying appratus, however, is extremely complicated with regard to all the measures which must be taken in order to raise and lower the nozzles and, moreover, to pass heated air therethrough.

OBJECTS OF THE PRESENT INVENTION

An object of the invention is to provide a drying appratus in which the printed surface can be spaced a desired distance from the plane in which the nozzles orifices are located and in which regulation of said distance is effected with simple means.

BRIEF DESCRIPTION OF THE DRAWINGS

These and other objects are fulfilled by the drying apparatus of the invention as hereinafter described with reference to the drawings in which.

DESCRIPTION OF A PREFERRED EMBODIMENT

Figure 1:
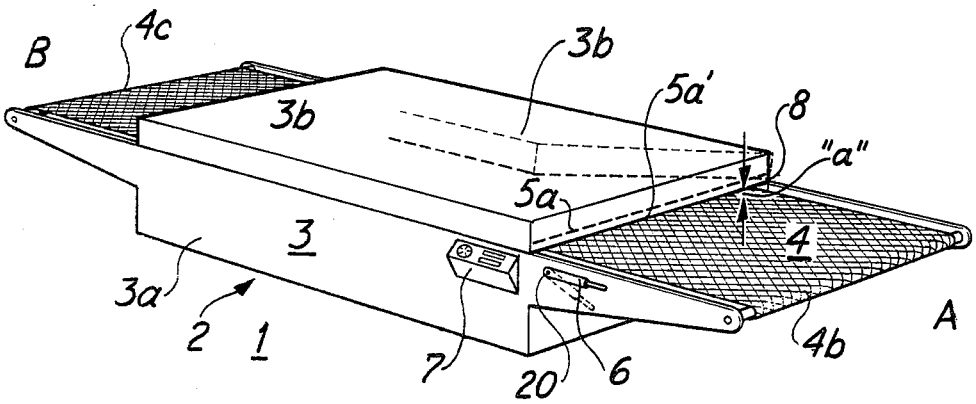
FIG. 1 shows diagrammatically and in perspective a simplified drying apparatus according to the invention.
Figure 3:
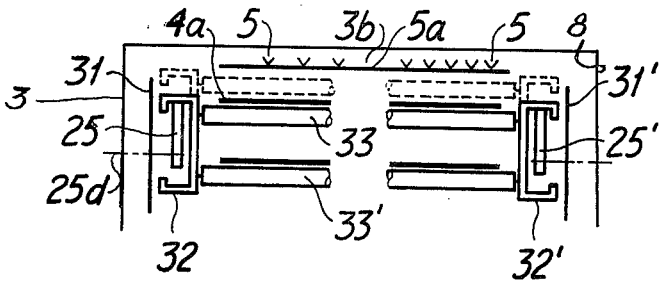

FIG. 1 shows in perspective a print-drying apparatus especially for use in conjunction with a silk-screen printing machine. The apparatus is shown resting on a supporting surface 1 and is generally identified at 2. The apparatus comprises a frame structure 3 which supports a horizontally movable conveyor path 4. The conveyor path 4 is intended to convey printed material, such as printed sheet of material, obtained from a printing machine, from a posititon A in which the printed material is fed to the apparatus, to a position B in which the material is received by a stacking means, wet print on the material is dried as it passes thorugh the apparatus. To this end the drying apparatus 2 is provided with means (not shown) for producing hot air. These means may, to advantage, be arranged in the lower portion 3*a* of the drying apparatus. The hot air passes through passages (not shown) to an apparatus 3*b* where it is permitted to pass through a plurality of nozzles 5 located therein (FIG. 3), the exit orifices of which lie on a common plane 5*a* above the horizontal plane 4*a* of the conveyor path.

Since the printed material is discharged from the printing machine at a determined height above the means supporting said machine it follows that the portion 4*b* of the conveyor path 4 must be correspondingly arranged so that it can receive the printed material from the printing machine. This portion 4*b* must therefore be fixed. The portion 4*c*, which is the portion of the conveyor path 4 at which the printed material is discharged therefrom is also preferably fixed. As will be seen from FIG. 1, the upper conveying surface of the path 4 is positioned at a distance, marked "*a*", from the opposing surface of the portion 3*b* and from the common plane 5*a* of the exit orifices of the nozzles located within the portion 3*b*. This distance "*a*" must be sufficiently large to enable the printed material to pass into the drying apparatus even when said material is of considerable thickness. When the distance "*a*" is excessively large, it will be obvious that large heat losses occur, since heated air is able to pass through the gap formed between the conveyor path and the opposing surface of the apparatus portion 3*b*. Thus, it is desirable to be able to adjust the distant "*a*" in a manner such that the printed material is able to pass just beneath the edge 5*a*" which demarcates said opposing surface.

Since it is suitable for the distance from the common plane of the nozzles exit orifices to the printed surface of the material to be approximately 15 mm, it is expedient for said common plane to be approximately 15 mm higher than the edge 5*a* ".

As will be understood from the following, the conveyor path can be raised and lowered so as to enable the distance between the upper conveying surface of the conveyor path and the common plane of the nozzles exit orifices to be adjusted. This raising and lowering of the path 4 is initiated by moving a handle 6.

The reference numeral 7 indicates an operating panel. As indicated in FIG. 1, the portion 3*b* is hinged at 8 in a manner to permit said portion to be lifted to the position shown in dash-lines, thereby enabling inspection of the conveyor path and of nozzles mounted on the inside of the portion 3*b*.

Figure 2:
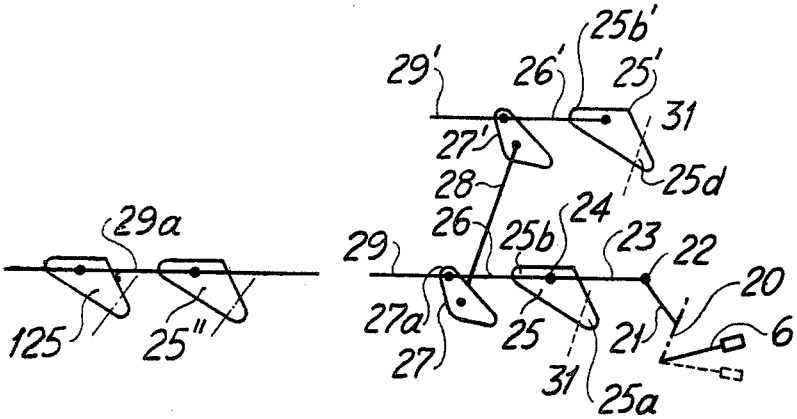
FIG. 2 illustrates diagrammatically the principle according to which the conveyor path can be raised and lowered with the aid of a frame structure and FIG. 3 is a simplified cross-sectional view through part of the frame structure and a further frame structure placed therein, said Figure showing the further frame sturcture in full lines in its lowermost position and in dashlines in its uppermost position, this latter position being immediately adjacent the plane in which the nozzles orifices are located.

FIG. 2 is a principle sketch of a linkage system with which the conveyor path can be raised and/or lowered relative to the nozzles. When the handle 6 occupies the position shown in full lines the distance "*a* " is the maximum obtainable, i.e. the drying apparatus is adjusted to dry printed material of excessive thickness. The handle 6 is connected to an arm 21 through a pin 20, the free end of the arm 21 co-acting with an operating rod 23 via a link 22. The operating rod 23 is rotatably mounted to a segment 25 through connecting means 24, said segment 25 serving as a lever arm. One end 25*a* of the segment 25 is rotatably attached to the frame structure, here marked 31, while the other end 25*b* of said segment is so arranged as to lift a U-shaped rail 32 when rotated.

The rotary movement of the segment 25 is transmitted to a further segment 27, which also serves as a lever arm, through a further operating rod 26. This further segment 27 is securely attached to a corresponding further segment 27 via a shaft 28, said corresponding further segment 27 being placed on the opposite side of the drying apparatus to the first mentioned segment 27.

Rotation of the arm 6 to the dash-line position shown in FIG. 2 will cause the operating rod to be moved to the right as seen in the Figure, which causes the segment 25 to rotate about one end 25*a* thereof about an axis 25*d*, which in turn causes the other end 25*b* of the segment 25 to lift as seen in FIG. 2. Simultaneous herewith, the operating rod 26 is moved to the right in FIG. 2, whereupon the end 27*a* of the further segment 27 moves to the right in FIG. 2, This rotary movement being transmitted by the shaft 28 to the segment 27 and, through the intermediary of an operating rod 26', also actuates the segment 25' for movement in the same manner as the segment 25. The portion 25*b'* of the segment 25 is thus also raised in a manner corresponding to the portion 25*b* of the segment 25.

A third operating rod 29 is arranged to co-act with a segment 25" in exactly the same manner as that described with reference to the segment 25.

It is assumed that the segments 25 and 25" are associated with one drying section of the drying apparatus. It is normal, however, for a drying appratus to comprise a plurality of drying sections, and in such a case the present invention enables a linkage system for one drying section to be readily coupled to a linkage system of another section through operating rod 29*a* which extends from the segment 25" associated with the first section to a segment 125 associated with said other section.

As will be seen from FIG. 2, the segments 25 and 25" are sequentially arranged on one side of the drying apparatus. These segments are intended to co-act with a U-shaped rail 32 shown in FIG. 3, similarly, segments 25' and a further segment (not shown) are provided on the opposite side of the drying apparatus to segments 25", 125, these former segments being intended to co-act with a U-shaped rail 32'.

The conveyor path 4 is arranged to pass a further frame structure arranged within the first mentioned frame structure adjacent the nozzles 5, said further frame structure comprising two parallel U-shaped rails which carry therebetween rollers for the conveyor path. These support rollers are referenced 33 in FIG. 3. Mounted on the U-shaped rail are further support rollers 33' for supporting the conveyor path during its return movement.

The two parallel U-shaped rails are arranged to co-act with the segment 25, 25' one end of each of which is pivotally mounted to the frame structure and the other end of each of which is arranged, when pivoted to lift the U-shaped rails and therewith also the rollers 33, so that said horizontal plane 4*a* is moved closer to the plane 5*a* on which the nozzle exit orifices lie.

Although the illustrated embodiment shows the provision of a further segment 27 for one U-shaped portion and that said segment shall be fixedly mounted to a pivot shaft with a corresponding further segment for the other U-shaped rails, and that the further segments are mounted to the segments 25, 25' through operating rods 26, 26', which segments upon rotation lift the U-shaped bar, it will readily be perceived that the segment 25 for U-shaped rail 32 can be fixedly mounted via a pivot shaft to corresponding segment 25' for the second U-shaped rail 32'.

Lifting of the further frame structure is thus directly dependent upon the position of rotation of the arm 6 and it is consequently proposed that the selected position of rotation of the arm 6 shall be lockable by means of locking devices not shown.

When the drying apparatus comprises a plurality of drying sections and each of said sections shall exhibit a further frame structure which is capable of being raised and lowered, it is suitable for at least one operating rod 29*a* to join the further frame structure in one drying section with the further frame structure in another drying section, this connection being effected between the segments 25' and 125.

The invention is not restricted to the described and illustrated embodiment, but can be modified within the scope of the following Claims.

What we claim is:

1. An ink-drying apparatus comprising a conveyor path which is movable in a generally horizontal plane, means for generating hot air within the apparatus, air-nozzles having exit orifices which lie in a common plane spaced from and above said conveyor path and are directed toward said conveyor path, and passages for conducting heated air from said generating means to said nozzles, wherein the apparatus further comprises a supporting frame structure having rollers, said rollers providing a supporting region of said conveyor path, means by which said supporting frame structure can be raised and lowered so as to selectively adjust the spacing between said conveyor path and said exit orifices, and said conveyor path being arranged to pass over a vertically fixed roller unrelated to the raising and lowering of said supporting frame structure.

2. In an ink-drying apparatus having a conveyor path movable in a horizontal plane, means for generating hot air within the apparatus, air nozzles having exit orifices which lie in a common plane that is spaced from and above said conveyor path and are directed toward said conveyor path, and passages for conducting heated air from said generating means to said nozzles, the improvement comprising a supporting frame structure in the apparatus having rollers for supporting a portion of said conveyor path, means for raising and lowering said supporting frame structure to selectively adjust the spacing between said conveyor path and said exit orifices, wherein the supporting frame structure exhibits two parallel U-shaped rails, and wherein the means for raising and lowering includes first segments arranged in the U-shaped rails which serves as lever arms, one end of respective segments being pivotally mounted to a fixed portion of the drying apparatus, and the other end of respective segments being arranged, when pivoted, to cause raising and lowering of the U-shaped rail.

3. A drying apparatus according to claim 2, wherein a segment for the U-shaped rail is fixedly connected to corresponding segment for the other U-shaped rail via a pivot shaft.

4. A drying apparatus according to claim 2, wherein a further segment serving as a lever arm and intended for one U-shaped rail is fixedly connected via a pivot shaft with a corresponding further segment for the other U-shaped rail and wherein the further segment is mounted to the segment which upon rotation causes raising and lowering of the U-shaped rail via an operating rod.

5. A drying apparatus according to claim 3, wherein the magnitude of the raising and lowering movement is dependent upon the position of rotation of an arm cooperating with said segments.

6. A drying apparatus according to claim 2, wherein said apparatus comprises a plurality of drying sections each of which has an elevatable frame structure, and wherein at least one operating rod connects the frame structure of a first drying section with the frame structure of a further drying section.

* * * * *